United States Patent [19]

Juuti

[11] Patent Number: 4,771,576

[45] Date of Patent: Sep. 20, 1988

[54] APPARATUS AND METHODS FOR FINISHING A LEVEL SURFACE

[76] Inventor: Kenneth D. Juuti, Pender Island, British Columbia, Canada, V0N 2M0

[21] Appl. No.: 922,189

[22] Filed: Oct. 23, 1986

[51] Int. Cl.[4] ..... B24B 7/00

[52] U.S. Cl. ..... 51/54; 51/126; 51/177; 51/283 R

[58] Field of Search ..... 51/54, 55, 56 R, 126, 51/166 TS, 170 T, 174, 175, 176, 177, 241 S, 281 R, 281 SF, 283 R

[56] References Cited

U.S. PATENT DOCUMENTS

| | | | |
|---|---|---|---|
| 1,195,555 | 8/1916 | Campbell | 51/177 |
| 1,352,582 | 9/1920 | Clarke | 51/176 |
| 1,725,899 | 8/1929 | Chase | 51/126 |
| 2,569,291 | 9/1951 | Davis | 51/126 |
| 2,801,506 | 8/1957 | Mills | 51/241 S |
| 2,992,520 | 7/1961 | Kish | 51/177 X |
| 3,701,223 | 10/1972 | Cole et al. | 51/241 S |
| 4,241,471 | 12/1980 | Elias | 51/126 X |

*Primary Examiner*—Robert P. Olszewski

*Attorney, Agent, or Firm*—Hughes, Cassidy & Multer

[57] ABSTRACT

Apparatus for abrading the surface of a workpiece in a manner level with a selected reference plane, e.g. a horizontal reference plane. The apparatus includes a wheeled carriage to which is connected an elongated boom. Extending downward from the end of the boom is an abrading element which is mounted for rotation in a selected reference plane which is preferably horizontal, and which is prevented form tilting in a longitudinal or transverse direction relative to the boom. The boom is connected to the carriage by an adjusting mechanism which allows the carriage end of the boom to be raised or lowered so that the surface of the abrading element may be brought to a position which corresponds to the selected reference plane.

13 Claims, 6 Drawing Sheets

APPARATUS AND METHODS FOR FINISHING A LEVEL SURFACE

TECHNICAL FIELD

The present invention relates to abrading apparatus and methods, and more particularly to apparatus and methods for abrading a surface in a level manner.

BACKGROUND OF THE INVENTION

Abrading operations are performed on a workpiece, for example, to achieve a smoother, level surface on the workpiece, or to remove unwanted material, such as paint, which has adhered to the workpiece surface. A common abrading or sanding operation is performed on wood products, such as furniture, in order to produce a smooth surface in preparation for painting or for finishing the furniture.

When sanding a planar surface, it is particularly desirable that the surface be finished so that is it level, and so that the surface of the workpiece does not appear distorted or disfigured due to an uneven sanding operation.

Achieving a smooth and level sanded surface can be somewhat difficult. Namely, it is difficult to maintain a conventional sanding apparatus in a level plane, particularly when the workpiece surface is uneven. Thus, there may be a tendency for a conventional sanding apparatus to follow any imperfections in the surface and by doing so, to accentuate these imperfections even more. On a larger surface, such as the top of a table, these imperfections in the level of the surface caused by an uneven sanding operation may be quite noticeable.

Conventional apparatus have been disclosed for performing various abrading operations. In U.S. Pat. No. 785,024 by Shaver, a polishing machine is disclosed which includes a frame supported by a pair of wheels which has a rotary disc which depends downwardly from the frame at a location forward of the wheels. The polishing apparatus is manually manipulated by a handle attached to the frame.

An apparatus for cleaning a vertical wall is disclosed in U.S. Pat. No. 1,044,423 by Rosa, which includes a wheeled carriage assembly which is supported on a floor and which has an arm extending upward from the carriage to which is attached a vertical rotating cleaning disc.

U.S. Pat. No. 1,195,555 by Campbell discloses a floor grinding and polishing machine having a carriage frame supported on a pair of wheels, and a rotary disc supported for horizontal rotating movement which is mounted on the carriage frame forward of the wheels.

A grinding machine, disclosed by Mummert et al in U.S. Pat. No. 1,413,928, includes an upstanding carriage supported on four wheels. An elongated arm extends horizontally from a top portion of the carriage and has a vertically rotating grinding wheel at its distal end.

In U.S. Pat. No. 1,725,899 by Chase, there is disclosed a stone grinding machine including a wheeled carriage for supporting a movable elongated frame on a track, and a horizontal rotating disc depending downwardly from the distal end of the frame.

Toffolo, U.S. Pat. No. 1,832,267, discloses a rotary polishing machine which includes a motor supported by a two-wheeled carriage which is connected to a pair of horizontally rotating polishing stones by an elongated boom member.

A surface finishing machine is disclosed in U.S. Pat. No. 2,507,052 by Robinson, which includes a frame having four downwardly depending members for supporting the frame, and a rotating disc which depends from a drive motor attached to the frame.

In Elias, U.S. Pat. No. 4,241,471, there is disclosed a glass polishing apparatus which is adapted to be mounted to the windshield wipers of a motor vehicle.

SUMMARY OF THE INVENTION

The present invention pertains to apparatus and ethods for abrading a surface in a level manner. The term abrading is meant to include such operations as sanding, grinding, polishing, finishing, or the like where an operation is performed on the surface of a workpiece to remove surface matter. The apparatus includes a carriage having a pair of wheels which ride on a supporting surface. Attached to the carriage is an elongated boom having a rotating horizontal abrading disc attached to the boom at a location opposite from its carriage end. The abrading disc is operatively connected to the boom in a anner that it is fixedly xounted for rotation in a selected plane, which is preferably horizontal. Thus, the abrading disc is prevented from tilting in a fore and aft or side-to-side direction relative to the boom. In an exemplary embodiment, the carriage end of the boom is attached to the carriage by means of a pair of vertical screws which are supported in the carriage for rotating movement. The vertical screws are interconnected by an endless chain so that rotation of a handle attached to one of the screws, causes the carriage end of the boom to be adjusted vertically. This in turn allows the angle of the abrading disc to be adjusted relative to the surface of the workpiece so that it may be placed in the preferred horizontal position. When the surface of the abrading disc is determined to be level, an electric motor, supported on the carriage, is activated which rotates the abrading disc. The carriage and boom assembly is anipulated by a handle attached to the abrading end of the boom so as to move the abrading disc across the surface of the workpiece.

Due to the fact that the abrading disc is fixedly connected to the boom for rotation in the selected plane, precise adjustment of the angle of the abrading disc relative to a selected reference plane is achieved by the vertical adjustment of the carriage end of the connecting boom. A change in the angle of the abrading disc relative to the selected reference plane is a function of the length of the boom as well as the amount of vertical adjustment.

In another exemplary embodiment, the abrading disc is mounted to and driven by a conventional portable electric drill motor which is releasably fixedly mounted to the boom.

It is an object of the present invention to provide apparatus for abrading a flat surface.

BRIEF DESCRIPTION OF THE DRAWINGS

These and other objects and advantages to the present invention will become more readily apparent upon reading the following Detailed Description and upon reference to the attached Drawings in which.

Figure 1:
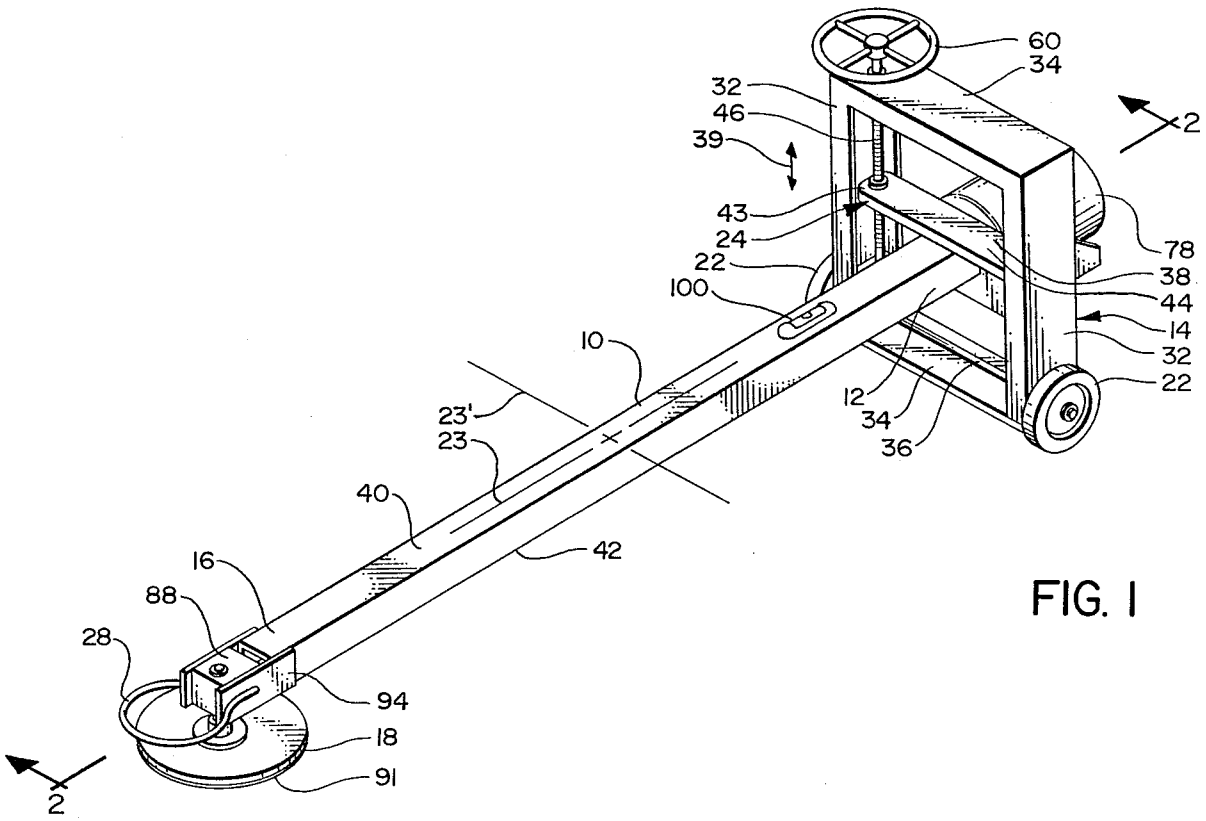
FIG. 1 is an isometric view of an exemplary embodiment of the apparatus of the present invention.

While the present invention is susceptible of various modifications and alternative forms, specific embodiments thereof have been shown by way of example in the Drawings and will herein be described in detail. It should be understood, however, that it is not intended to limit the invention to the particular forms disclosed, but on the contrary, the intention is to cover all modifications, equivalents and alternatives falling within the spirit and scope of the invention.

DETAILED DESCRIPTION

The present invention pertains to an apparatus for abrading a flat surface, and in particular a flat surface having a large area, in a manner that the abrading operation is performed over a level plane.

In a first exemplary embodiment, the principal elements of the present invention as shown in FIG. 1, include a horizontal boom 10 which is mounted by its proximal end 12 to a wheeled carriage indicated at 14, and by its distal end 16 to a rotatably mounted abrading element 18. The abrading element 18 is fixedly mounted to the boom 10 in a conventional manner to permit rotation of the abrading element 18 in a selected plane, which is preferably a horizontal plane. Thus, the abrading element is prevented from tilting in relation to the boom 10 in a longitudinal or transverse direction. Connected to the carriage 14 are a pair of wheels 22 which ride upon a flat and level supporting surface, such as a bench or table, which is located at the desired working level. The connecting boom 10 is mounted to the carriage 14 by means of a vertically adjustable mechanism indicated at 24, by which the proximal end 12 of the connecting boom can be raised or lowered to the desired level in order to adjust the angle $\theta$ (FIG. 4) which the lane of abrading element 10 forms with a selected reference plane, e.g. a horizontal reference plane. After levelling the abrading element 18, and in order to accomplish an abrading operation, a handle 28 connected to the abrading end 16 of the connecting boom 10 is grasped by the operator and moved over the workpiece surface. The wheels 22 support the carriage during movement of the abrading disc 18 and carriage assembly therewith.

Having described the principal elements of the present invention, a more detailed description is provided by referring to FIG. 1. Carriage assembly 14 includes an upstanding box-like frame including vertical support walls 32 which are rigidly joined at their respective upper and lower ends by horizontal endwalls 4. In order to support carriage 14 for movement across a supporting surface, an axle 36 extends horizontally between and through vertical walls 32 at their lower portions. Mounted vertically on opposite ends of axle 36 outside of vertical walls 32 are carriage wheels 22.

Connecting boom 10, having a longitudinal axis designated by a line 23 and a transverse axis designated by a line 23' is mounted to carriage 14 by means of vertical adjusting mechanism 24 in a manner generally perpendicular to the plane formed by vertical walls 32 and endwalls 34. Adjusting mechanism 24 includes an elongated adjusting plate 38 i) which lies parallel to upper, lower endwalls 32, 34, in a manner perpendicular to boom axis 23, and ii) which is adjustable in a vertical direction designated by an arrow 39. Connecting boom 10, which has a generally square cross-sectional configuration with an upper surface 40 and a lower surface 42, is rigidly joined at upper surface 40 to the bottom surface of adjusting plate 38. In the present embodiment, connecting boom 10 is a one piece member which is sized to a length which is sufficient to extend across the surface of the workpiece.

Figure 3:
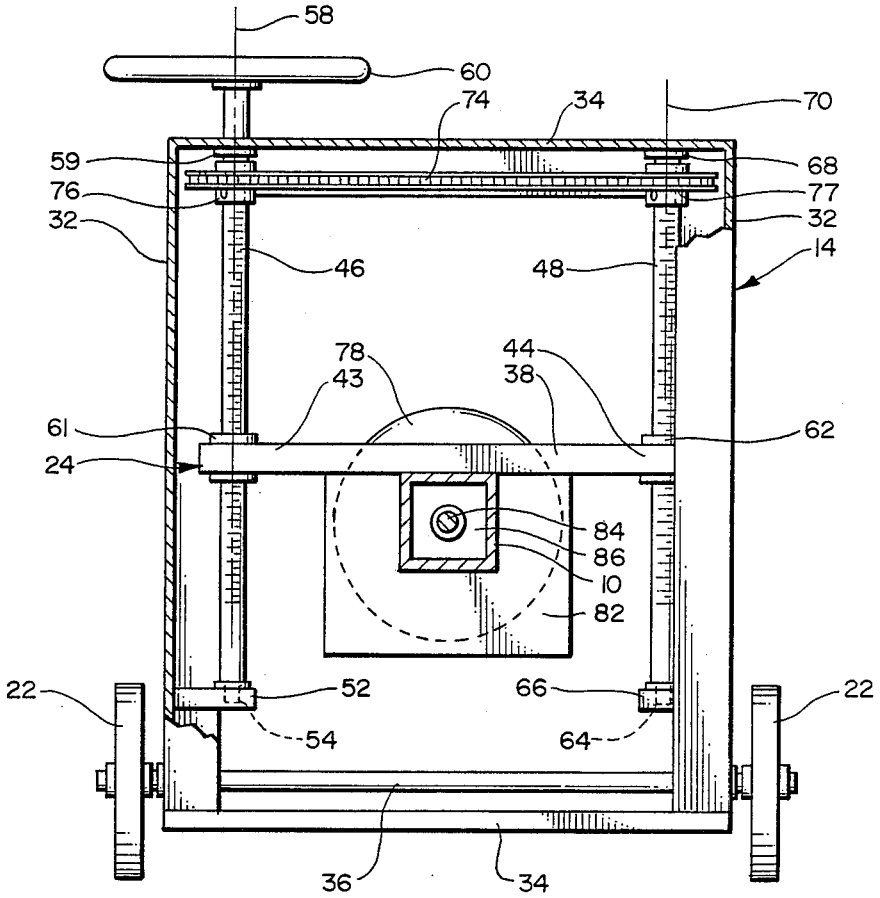
FIG. 3 is a front sectional view of the apparatus taken along 3—3 of FIG. 2.

As shown in FIG. 3, to permit the vertical adjustment of adjusting plate 38 and connecting boom 10 therewith, adjusting plate 38 is threadably engaged at opposite ends 43, 44 to helically threaded left, right vertical screws 46, 48, respectively. Left adjusting screw 46, located somewhat inboard of vertical wall 32 and having and elongated threaded shaft, is rotatably enaged at its lower end to a horizontal flange 52. Flange 52 extends inwardly from the inner surface of left vertical wall 32 and includes a cylindrical opening extending downwardly from its upper surface to receive a complementary shaped lower tip 54 of left adjusting screw 46 for rotatable movement therein as adjusting screw 46 is rotated about its vertical axis designated by a line 58. The upper end of adjusting screw 46 is journalled in a vertical collar 59 of upper endwall 34 and is rigidly joined to a handwheel 60 located above upper endwall 34. Support for left end 42 of adjusting plate 38 is provided by a threaded sleeve 61 which extends vertically through adjusting plate 38 and which is threadably engaged to vertical screw 46.

In order to provide support for the opposite end 44 of adjusting plate 38, plate 38 is threadably engaged to vertical adjusting screw 48 through a threaded sleeve 62 extending vertically through adjusting plate 38. Adjusting screw 48, which is located somewhat inboard of right vertical wall 32, includes a rigidly attached cylindrical tip 64 which is engaged within a vertical opening of a flange 66 which in turn extends horizontally inboard from the right vertical wall 32. The upper end of adjusting screw 48 is journalled within a collar 68 which is rigidly connected to the lower surface of upper endwall 34 to permit rotational movement of adjusting screw 48 about a vertical pivot axis designated by a line 70 and which is generally parallel to pivot axis 58.

Vertical adjustment of adjusting plate 38 by rotation of handwheel 60 is achieved by the simultaneous rotation of adjusting screws 46, 48 which are interconnected at their upper ends by eans of an endless chain 74 extending laterally therebetween. Endless chain 74 is engaged by gear wheels 76, 77 which are rigidly mounted to adjusting screws 46, 48, respectively, for rotation therewith in a horizontal plane. The rotation of handwheel 60 causes adjusting screw 46 to rotate about its axis, and this rotation is transmitted via endless chain 74 to the right adjusting screw 48. The simultaneous rotation of adjusting screws 46, 48 cause adjusting plate 38 to move vertically on adjusting screws 46, 48 relative to the carriage frame.

Figure 2:
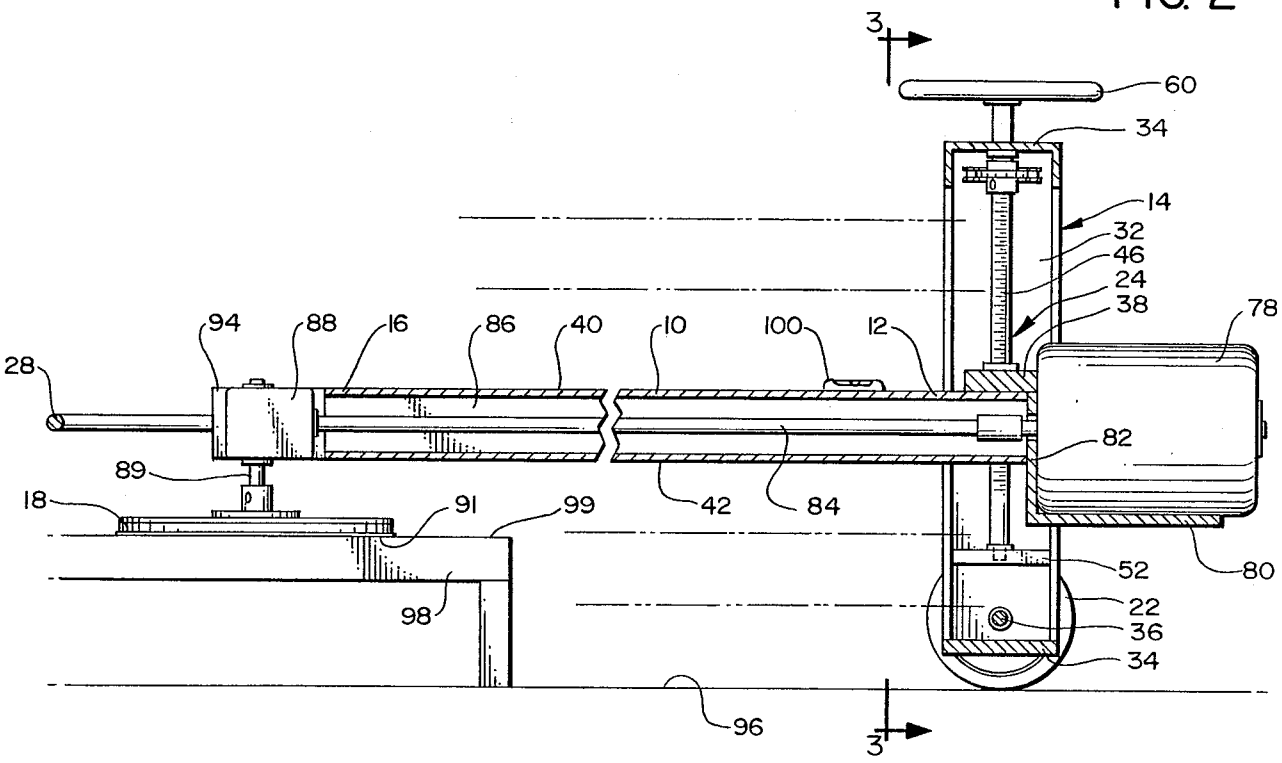
FIG. 2 is a side sectional view of the apparatus taken along line 2—2 of FIG. 1 showing the apparatus in a position for an abrading operation.

Power to drive abrading element 18 is provided by a conventional electric motor 78 which is supported on a horizontal platform 80 (FIG. 2) which in turn includes in upstanding forward wall 82. Forward all 82 is rigidly joined to the carriage end 12 of connecting boom 10 and to the lower surface of adjusting plate 38 so that most of the weight of motor 78 is supported on carriage wheels 22.

Power is transmitted from electric motor 78 via a drive shaft 84 which extends through platform wall 82 and within an internal longitudinal passageway 86 of connecting boom 10 to the abrading end 16. Rotatably engaged to drive shaft 84 at abrading end 16 by means of a conventional gear box 88 is a vertical shaft 89, which is perpendicular to a horizontal plane formed by the longitudinal and transverse axes of the boom, and which drives the rotary abrading element 18. Abrading element 187 which is rigidly connected to drive shaft 89 in a manner perpendicular to shaft 89, includes a circular abrading disc having a lower planar surface 91 which rotates in a horizontal plane which is parallel to the horizontal plane through boom axis 23. This is accomplished by the fact that the abrading element is mounted to drive shaft 89 which in turn is connected to gear box 88 so that abrading element 18 is held rigidly in relation to boom axis 33. Thus, during an abrading operation, lower surface 91 of abrading element 18 is prevented from tilting in a fore and aft or left and right direction so as to maintain a level sanding surface. In order to manipulate the apparatus, a U-shaped handle 28 is attached to a housing 94 which in turn is rigidly connected to abrading end 16 of connecting boom 10. Housing 94 supports gear box 88 in a manner so that rotation of drive shaft 84 causes a corresponding rotation of drive shaft 89 and abrading disc 90.

Operation of the apparatus of the present invention is as follows. After finding a suitable, flat and level supporting surface, such as a table surface 96, shown in FIG. 4, a workpiece such as a table 98 is set on the supporting surface 96. The lower surface 91 of abrading disc 90 is brought to rest upon the upper surface 99 of workpiece 98. The abrading disc 90 is adjusted to a location level to a desired reference plane. which may be, for example, a horizontal reference plane. If the selected reference plane lies in the horizontal plane, then adjustment of abrading disc 90 is facilitated by utilization of a bubble level 100 which is attached to connecting boom 10 so that the level is parallel to boom axis 23. By referring to the bubble level 100, adjusting plate 38 and the carriage end 12 of the connecting boom 10 are raised or lowered by rotation of handwheel 60 until there is an indication at the level 10 that the lower surface 91 f abrading disc 90 is level. This is achieved by the fact that abrading disc 90 is mounted to connecting boom 10 so that lower surface 91 is parallel to the longitudinal axis 23 of connecting boom 10. In addition, to obtain a level, horizontal sanding operation it is important that supporting surface 96 be horizontal.

Figure 4:
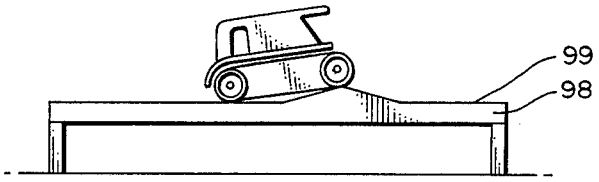
FIG. 4 is a pictorial representation of the operation of a conventional sanding apparatus when sanding an uneven workpiece surface which is somewhat exaggerated for purposes of illustration.

Assuming, for example, that the position of carriage end 12 of boom 10 is too high relative to the workpiece 98 as shown in FIG. 4, this results in carriage 14 being inclined in a forward direction with the lower surface 91 of abrading element 18 inclined at an acute angle $\theta$ with the selected reference lane. However, as adjusting plate 38 is lowered by the rotation of handwheel 60, carriage 14 pivots about axle 36 to the erect vertical position shown in FIG. 2 thereby causing a decrease in angle $\theta$ until the surface 91 of abrading element 18 and workpiece surface 99 are co-planar.

After the abrading disc 90 is leveled by manipulation of handwheel 60 (FIG. 2), electric motor 78 is started, and the handle 28 is grasped by the operator. The abrading operation proceeds by mani1ulation of abrading disc 18 across the upper surface 99 of the workpiece 98. This movement across the workpiece 98 is facilitated by the rotation of carriage wheels 22 across the supporting surface 96.

Figure 5:
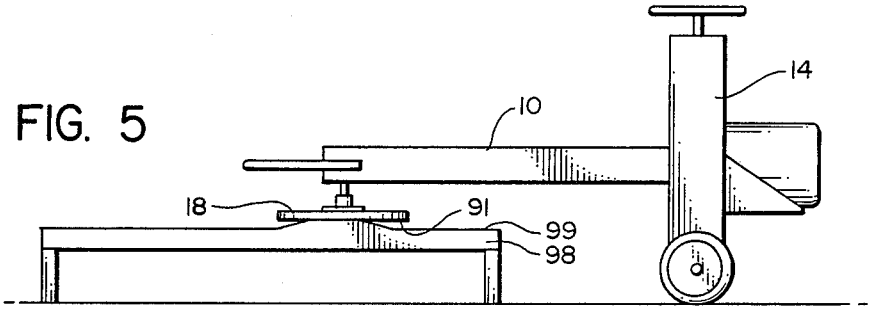
FIG. 5 is a pictorial representation of the operation of the sanding apparatus of the present invention when sanding an uneven workpiece surface which is somewhat exaggerated for purposes of illustration.
Figure 6:
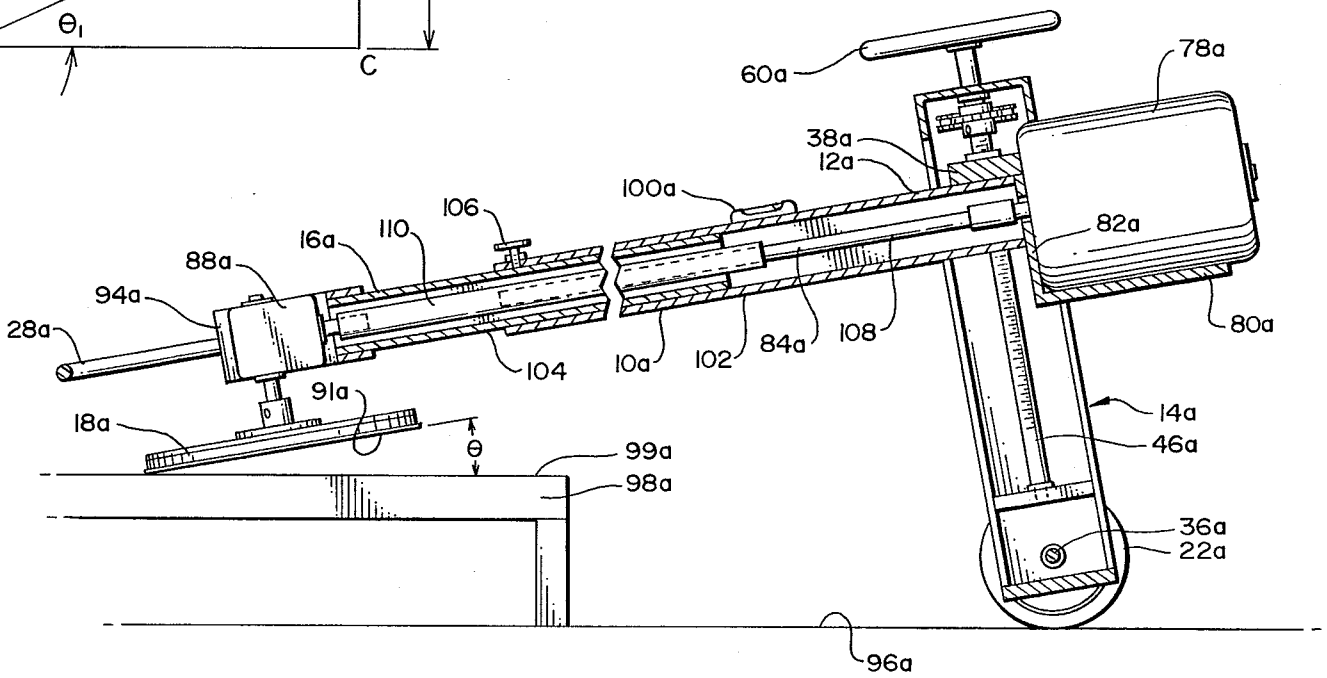
FIG. 6 is a side sectional view of a second exemplary embodiment wherein the length of the connecting boom is axially adjustable and showing a position of the apparatus prior to a vertical levelling adjustment.
Figure 7:
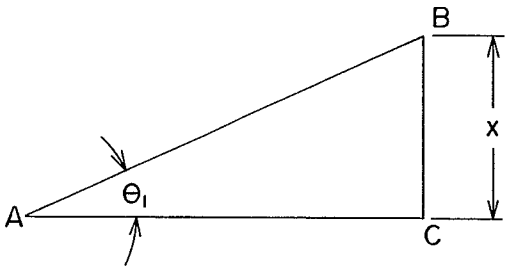
FIG. 7 is a diagram illustrating the relationship of the angle $\theta$ between the abrading disc and a selected reference plane as a function of a vertical adjustment of the boom assembly as well as the length of the boom.

In the present invention, any high spot upstanding from the workpiece surface is engaged by the planar rotating surface 91. Thus, while a conventional sander tends to follow the surface of a high spot as shown in FIG. 4, the sanding surface 91 of the present invention is held rigidly for rotation within the selected horizontal plane when encountering the high spot as shown in FIG. 5. Since there is no change in the position of the sanding surface 91 when encountering the high spot, it is sanded horizontally to the level of the remaining surface.

In a second exemplary embodiment of the present invention, shown in FIG. 4, the elements shown in the previous embodiment are designated by like numerals with the suffix "a" attached. In the present embodiment, connecting boom **10*a* includes a first sleeve portion 102 at carriage end 12*a* which is engaged to carriage 14*a*, and a second sleeve portion 104 at abrading end 16*a* which is slidably engaged within first sleeve portion 102 for axial movement relative to sleeve portion 102 to vary the distance between abrading element 18*a* and carriage 14*a* as desired. Second sleeve portion 104 is fixedly engaged to first sleeve portion 102 at selected distances of boom 10*a* by means of a screw fastener 106 which is threadably engaged within sleeve portion 102 for vertical adjustment therewithin. When desired, the end of fastener 106 is secured against the outer surface of second sleeve portion 404 to prevent axial slidable movement of sleeve portion 104 within sleeve portion 102. To allow for axial adjustment of second sleeve portion 104, drive shaft 84*a* includes a first shaft portion 10 which is connected to motor 78*a*, and a second shaft portion 110 which is connected to gear box 88*a*. First shaft portion 108 is splined to second shaft portion 110** in a conventional anner to permit their relative axial slidable movement.

Referring to FIG. 4, in order to achieve the precise adjustments necessary to insure that the surface 91 of abrading disc 90 is level with the selected reference plane, the vertical adjustment of connecting boom 10 is made at carriage end 12 which is located at the opposite end of boom 10 from abrading disc 90. The change in a vertical distance of adjusting plate 38, resulting from rotation of handwheel 60, and designated as $\Delta x$, causes a change in angle $\theta$ which is formed by the surface 91 of the abrading disc and the selected reference plane. As shown geometrically in FIG. 5, the change in the angle $\theta$ is defined by the relationship $\Delta\theta = \tan^{-1}\Delta x/AC$ where $\Delta\theta$ is an angle formed by the surface 91 of abrading disc and the selected reference plane, and AC is the distance between a wheel axle 36 (FIG. 1) and the outer left end of abrading element 18. It should be apparent that a change in angle $\theta$ is both a function of the vertical distance $\Delta x$ and the distance AC, which is primarily a function of the length of boom 10. Thus, for example, an increase in the length of boom 10 will require a greater change in the vertical adjustment $\Delta x$, to achieve the same change in angle $\theta$. This results in changes in angle $\theta$ being sensitive to changes in the position of handwheel 60, allowing for a more precise adjustment of angle $\theta$.

Figure 8:
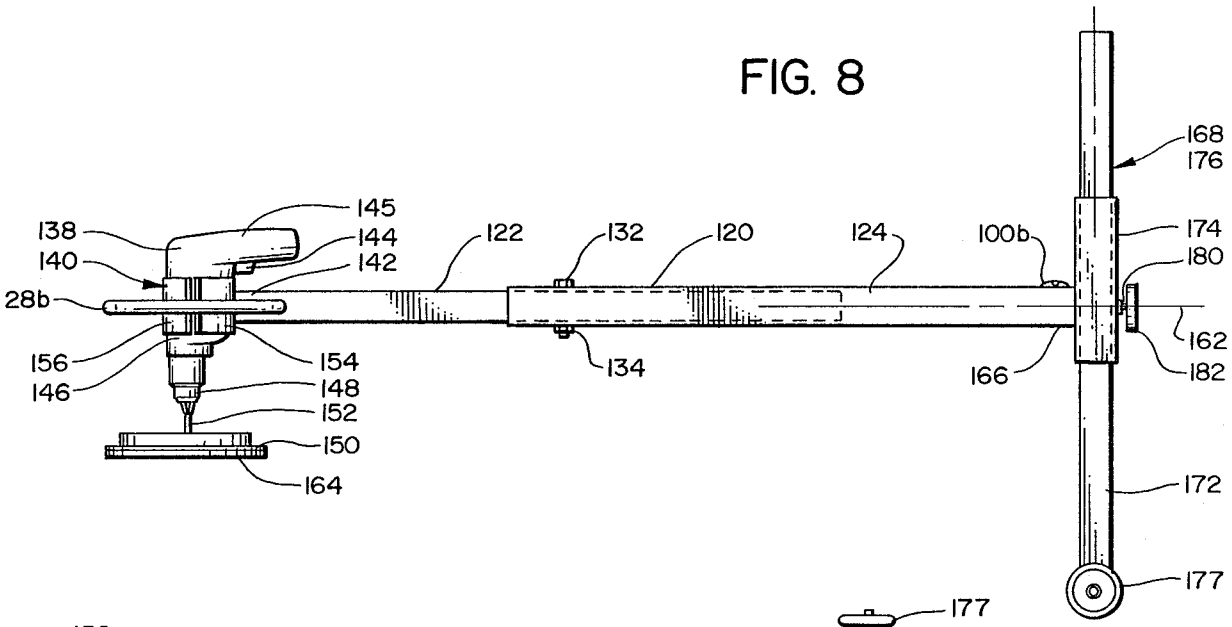
FIG. 8 is a side view of a third exemplary embodiment of the present invention for supporting a conventional portable sanding tool.
Figure 9:
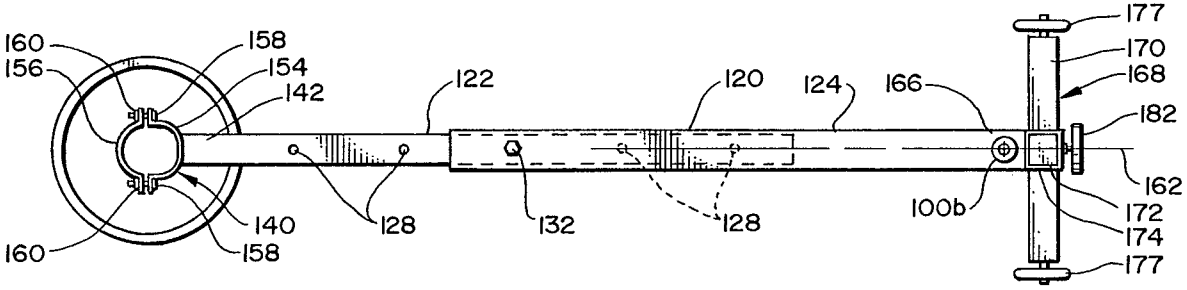
FIG. 9 is a top view of the embodiment shown in FIG. 8.

In a third embodiment of the present invention shown in FIGS. 8 and 9, like elements of previous embodiments are designated by like numerals with the suffix "b" attached. In the present embodiment there is shown an elongated boom 120 including a left inner sleeve portion 122 and a right outer sleeve portion 124. Sleeve portions 122, 124 have a rectangular cross-sectional. configuration and are joined in a manner that inner sleeve portion 122 is slidably engaged within the outer sleeve portion 124 so as to vary the length of boom 120 as desired. To rigidly fix the position of sleeve 122 relative to 124, sleeve 122 includes a number of vertical through-holes 128 which when selectively aligned with a vertical through-hole (not shown) of outer sleeve 124. receive a vertical threaded bolt 122 therethrough and Which is secured by a threaded nut 134.

To support a conventional portable electric drill motor 138 in a vertical manner, a fastener bracket indicated at 140 is rigidly mounted to the distal end 142 of boom 120. Drill motor 138 includes an "on/off" trigger 144, a handle 145, a housing 146 and a chuck 148 which is adapted to operatively connect a removeable sanding element 150 having a vertical shaft 152 which is engaged by the chuck 148. Fastener bracket 140 includes a right U-shaped portion 154 which is rigidly fastened to the distal end 142 of boom 120 and which is also fastened to an opposing left U-shaped portion 156 by a air of horizontally threaded bolts 158 and threaded nuts 160. Clamping portions 154, 156 form a somewhat cylindrical shape and are configured to fit rigidly around drill housing 146. Fastener bracket 140 engages housing 146 in a manner that during rotation of sanding element 150 in a horizontal plane which is parallel to the longitudinal axis of boom 120, and designated by a line 162, a lower planar surface 164 of sanding element 150 is prevented from tilting in a fore and aft or side to side direction.

Boom 120 is supported at its proximal end 166 by a carriage assembly indicated at 168 which is the present embodiment includes a lower horizontal elongated cross member 170. A vertical upstanding elongated member 172 is rigidly fastened at the middle of cross member 170. Upstanding member 172 has a rectangular cross-sectional configuration in order to receive a rectangular sleeve 174 thereabout. Sleeve 174, which includes a longitudinal axis designated by a line 176, is rigidly connected to boom 120 in a manner that the sleeve axis 176 is perpendicular to the boom axis 162. Adjustment of the proximal end 166 of boom 120 is achieved by vertical slidable movement of sleeve 174 along upstanding member 172. Sleeve 174 is fixedly engaged to selected locations of upstanding member 172 by a set screw 180 which extends laterally through sleeve 174 to engage upstanding member 172, and which has a knob 180 adapted for manual adjustment.

Carriage assembly 168 is supported by a pair of wheels 176 which are mounted to the opposite ends of a shaft (not shown) which extends through lower cross member 170. It should be appeciated that carriage assembly 168 operates to raise and lower the proximal end 166 of boom 120 in order to accomplish a similar leveling operation which was described in reference to carriage assembly 14 in the previous embodiments. That is, the adjustment of the boom 120 causes the lower surface 164 of sanding element 150 to be positioned in the horizontal plane as indicated by bubble level **100*b*. However, in the present embodiment, since there is no need to support a heavy motor assembly as in the previous embodiments, the carriage assembly 118 is somewhat less complex than the carriage assembly 14** described in the previous embodiments.

Operation of the sanding apparatus of the present embodiment is similar to that described with reference to the previous embodiments. The length of boom 120 is adusted by simply removing bolt 132 and aligning the desired hole 128 with hole 132 and reinserting the bolt into the aligned holes.

What is claimed is:

1. Apparatus for abrading the surface of a workpiece in a selected reference plane, said apparatus comprising:

a. an elongated boom means having a first end portion, a second end portion, a longitudinal axis, and a transverse axis;

b. an abrading assembly comprising a rotatable drive shaft which extends downwarly from said first end portion of said boom means and which is fixedly oriented to said boom means in a manner that an axis of rotation of said shaft maintains a fixed angular relationship to both the longitudinal axis and the transverse axis of said boom means, and also comprising an abrading member mounted to said shaft so as to be rotatable therewith and having a fixed angular relationship to said shaft, said abrading member having an abrading surface which is adapted to be positioned in an operating plane parallel to said reference plane and rotatable in said operating plane in a manner that said abrading member is prevented from tilting in a longitudinal or transverse direction with respect to said boom means in order to perform on said workpiece surface an abrading operation which is closely located along said reference plane;

c. an upstanding carriage assembly including a frame having a lower support portion which is adapted to engage a planar supporting alignment in a manner to allow movement of said carriage assembly on the supporting alignment surface in a forward and rearward longitudinal direction and a side to side transverse direction an to permit a pivoting movement about a first pivot axis parallel to said supporting surface;

d. means for connecting said second end portion of said boom means to said carriage assembly in a manner to permit a vertical adjustment of the position of the second end portion relative to the first end portion along a vertical axis, with an angle formed between the vertical adjustment axis and the longitudinal axis of the boom being fixed to cause a change in an angle formed by said abrading surface and the selected reference plane as the second end portion is vertically adjusted and the carriage assembly is pivoted about said first pivot axis, to allow said abrading surface to be positioned in a manner parallel to the selected reference plane;

e. said boom means including a handle means rigidly connected to said second end portion and adapted to be engaged by an operator to move said abrading member in a lateral direction in a manner that said abrading surface moves across said workpiece in said operating plane and said carriage assembly is moved across said supporting surface.

2. The apparatus as set forth in claim 1 wherein:

a. said connecting means includes an upstanding member which is operatively connected to said second end portion in a manner that substantial alignment component of said upstanding member is perpendicular to said longitudinal axis; and b. said upstanding member is adjustable to permit said vertical adjustment of said second end portion.

3. The apparatus as set forth in claim 2 wherein said upstanding member is operatively connected to said carriage assembly in a manner that during said vertical adjustment of said second end portion said carriage assembly is caused to pivot relative to said supporting surface about the first pivot axis so that said upstanding member is pivoted to a vertical position.

4. The apparatus as set forth in claim 1 wherein a. said lower abrading surface and said selected reference plane form an adjusting angle $\theta$;

b. said first end portion of said boom means is adjustable through a vertical distance x;

c. said abrading means is separated from said first pivot axis by a distance D; and d. said adjusting angle $\Delta\theta$ is defined by the equation $\Delta\theta = \tan^{-1} \Delta x/D$ where $\Delta x$ is equal to an amount of movement of said first end portion through said vertical distance x.

5. The apparatus as set forth in claim 4 wherein said elongted boom means includes first and second elongated boom portions, and means for connecting said first boom portion to said second boom portion to permit axial movement of said first boom portion relative to said second boom portion to change the distance D so as to vary the sensitivity of a change in adjusting angle $\theta$ to a change in vertical distance x.

6. The aparatus as set forth in claim 1 wherein said connecting means include:

a. vertical screw means rotatably mounted to said carriage frame for rotation about a vertical rotational axis which has a substantial alignment component which is perpendicular to said longitudinal axis; and b. means for threadably connecting said first end portion to said screw means in a manner that rotation of said screw means about said rotational axis causes said vertical adjustment of said first end portion relative to said carriage frame through a vertical distance x.

7. The apparatus as set forth in claim 6 wherein said screw means comprises:

a. a first vertical threaded screw member which is rotatably mounted to said carriag frame;

b. a second vertical threaded screw member which is rotatably ounted to said carriage frame in a manner generally parallel to said first screw member;

c. belt means for engaging said first screw member and said second screw member in a manner that rotation of said first screw member about said first rotational axis causes a corresponding rotation of said second screw member about said second rotational axis;

d. flange means threadably engaged to said first screw member and to said second screw member so that rotation of said first and second screw members relative to said frame causes said flange means to move on said first and second screw members in a vertical direction; and e. means for connecting said first portion of said boom means to said flange means for movement of said first end portion with said flange means to perform said vertical adjustment.

8. The apparatus as set forth in claim 7 wherein said abrading assembly includes means for driving said abrading member for rotation through said operating plane, abrading assembly including:

a. motor means mounted to said carriage assembly;

b. transmission shaft means engaged to said motor means and extending from said carriage assembly in a manner parallel to said boom means; and c. said drive shaft being engaged to said transmission shaft means at said second end portion, said drive shaft extending downwardly from said transmission shaft means to a rigid connection with said abrading member.

9. The apparatus as set forth in claim 1 wherein a. said carriage assembly includes an upsta;ing elongated support member b. said connecting means includes a sleeve, having a longitudinal axis, which is slidably engaged to said upstanding support member for generally vertical ovement thereon., c. said sleeve is rigidly connected to said elongated boom means in a manner that the longitudinal axis of said sleeve is perpendicular to the longitudinal axis of said boom means; and d. said abrading means includes motor assembly which is operatively connected to said elongated boom means at said first end portion and which operates said lower abrading surface in a manner to perform an abrading operation of said workpiece surface.

10. The apparatus as set forth in claim 9 wherein said motor means is a portable motor which is releasably engaged to said boom means.

11. A method for abrading the surface of a workpiece in a selected reference plane above a level supporting surface, the method comprising the steps of:

a. providing an elongated boom having a first end portion, a second end portion, a longitudinal axis, and a transverse axis;

b. mounting an abrading member having a planar abrading surface to the first end portion so that the abrading member connects to a rotatable shaft which extends downward from the boom in a manner that (i) the abrading surface is maintained for rotation in a first plane which is parallel to both the longitudinal axis and the transverse axis of the longitudinal axis of the boom, and (ii) the abrading surface is prevented from tilting in a longitudinal or transverse direction with respect to the boom means;

c. providing an upstanding carriage assembly including a frame having a loer support portion which engaes the level supporting surface in a manner to allow movement of the carriage assembly on the supporting surfae in a forward and rearward longitudinal direction and a side to side transverse direction and to permit a pivoting movement about a first pivot axis parallel to said supporting surface;

d. connecting the second end portion of the boom to said carriage assembly in a manner that the second end portion is adjustable in a vertical direction relative to the first end portion along a vertical axis with an angle formed between the vertical adjustment axis and the longitudinal axis of the boom being fixed;

e. adjusting the position of the second end portion of the boom in the vertical direction to cause a change in an angle formed by the abrading surface of the abrading member and the selected reference plane by a pivotal movement about said first pivot axis to allow the abrading member to be positioned in a manner parallel to the selected reference plane; and f. manipulating handle means at the second end portion of the boom in a manner that the abrading surface of the abrading member is moved across the surface of the workpiece while being maintained in sid selected reference plane and the carriage assembly is moved across the supporting surface.

12. The metho as set forth in claim 11 wherein:

a. the abrading membe and the selected reference plane form an adjusting angle $\theta$;

b. the second end porion of the boom is adjustable through a vertical distanc x;

c. the abrading membe is separated from the first pivot axis by a distance D;

d. an adjusting angle $\theta$ is defined by the formula $\Delta\theta = \tan^{-1} \Delta X/D$ wherein $\Delta$ X is equal to an amount of movement of tne second end portion through the vertical distance x;

e. first and second eiongated boom portions of the elongated boom are connected to permt lengthwise adjustment, said method further comprising oving the first boom portion relative to the second boo portion in order to change the distance D so as to vary te sensitivity of a change in adjusting angle 0 to a chage in vertical distance x.

13. The method as set forth in claim 11 additionally comprising the step of threadably connecting the second end portion of the boom to vertical screw means attached to the carriage, said method further comprising rotating the screw menas about a vertical pivot axis to cause vertical movement of the second end portion relative to the carriage frame.

* * * * *